United States Patent [19]

Hertell et al.

[11] Patent Number: 4,850,814

[45] **Date of Patent: * Jul. 25, 1989**

[54] HYDRAULIC GEAR PUMP

[75] Inventors: Siegfried Hertell, Radevormwald; Dieter Otto, Ennepetal, both of Fed. Rep. of Germany

[73] Assignee: Barmag AG, Remscheid, Fed. Rep. of Germany

[ * ] Notice: The portion of the term of this patent subsequent to Jun. 14, 2005 has been disclaimed.

[21] Appl. No.: 118,660

[22] Filed: Nov. 9, 1987

Related U.S. Application Data

[63] Continuation-in-part of Ser. No. 73,647, Jul. 15, 1987, Pat. No. 4,813,853, which is a continuation-in-part of Ser. No. 32,339, Jan. 9, 1987, Pat. No. 4,750,867.

[30] Foreign Application Priority Data

Aug. 7, 1987 [EP] European Pat. Off. ..... 87111451.8

[51] Int. Cl.[4] ..... F04B 49/02

[52] U.S. Cl. ..... 417/295; 417/310; 184/6.3; 184/7.4

[58] Field of Search ..... 417/281, 295, 310; 184/6.3, 7.4

[56] References Cited

U.S. PATENT DOCUMENTS

| | | |
|---|---|---|
| 1,537,013 | 5/1925 | Jeffers . |
| 1,861,155 | 5/1932 | Douglas . |
| 2,550,967 | 5/1951 | Burks et al. . |
| 2,916,999 | 12/1959 | Christenson et al. . |
| 2,918,009 | 12/1959 | Crevoisier . |
| 2,997,227 | 8/1961 | Ternent . |
| 3,407,741 | 10/1968 | Weber et al. . |
| 4,480,962 | 11/1984 | Niemiec . |
| 4,553,966 | 11/1985 | Boller . |
| 4,642,033 | 1/1987 | Boller . |
| 4,676,964 | 6/1987 | Hertell . |

FOREIGN PATENT DOCUMENTS

| | | |
|---|---|---|
| 409134 | 1/1924 | Fed. Rep. of Germany . |
| 2425022 | 12/1975 | Fed. Rep. of Germany . |
| 2718886 | 9/1978 | Fed. Rep. of Germany . |
| 2758376 | 7/1979 | Fed. Rep. of Germany . |
| 2815362 | 10/1979 | Fed. Rep. of Germany . |
| 2933084 | 8/1981 | Fed. Rep. of Germany . |
| 3210759 | 10/1983 | Fed. Rep. of Germany . |
| 3444859 | 6/1985 | Fed. Rep. of Germany . |
| 3506629 | 10/1985 | Fed. Rep. of Germany . |
| 912425 | 8/1946 | France . |
| 2543615 | 10/1984 | France . |
| 385632 | 3/1965 | Switzerland . |
| 9359 | 6/1916 | United Kingdom . |
| 836321 | 6/1960 | United Kingdom . |
| 1374524 | 11/1974 | United Kingdom . |
| 2049823 | 12/1980 | United Kingdom . |
| 2069609 | 8/1981 | United Kingdom . |

*Primary Examiner*—William L. Freeh

*Attorney, Agent, or Firm*—Bell, Seltzer, Park & Gibson

[57] ABSTRACT

A hydraulic gear pump for the oil lubrication system of an automobile engine is disclosed, and wherein the meshing teeth of the gears define fluid cells which are expanded in the intake portion and receive the fluid from an inlet, and then compressed in the discharge portion to expel the fluid. The inlet to the pump includes at least two parallel fluid lines which are each connected to a tank. A pressure controlled valve is connected to one or both of the fluid lines, and during the normal operating range of output pressure, the valve is controlled by the pressure in the pump discharge chamber so as to decrease the flow through the lines from a maximum flow rate to a lower flow rate as the output pressure increases. In the event the engine and oil are cold, the output pressure will increase beyond the normal operating range, since the oil consumption is small. To heat this oil, the valve also includes means for throttling a portion of the output of the pump when the output pressure reaches a predetermined relatively high relief pressure which is greater than the normal operating pressure, and this throttling serves to rapidly increase the temperature of the oil. Also, the inlet fluid lines are designed to provide a flow rate during such throttling which is at least about 30% of the maximum flow rate during normal operation, to thereby assure sufficient flow for the throttling function.

15 Claims, 4 Drawing Sheets

HYDRAULIC GEAR PUMP

REFERENCE TO RELATED APPLICATIONS

This is a continuation-in-part of copending application Ser. No. 073,647, filed July 15, 1987, now U.S. Pat. No. 4,813,853, which in turn is a continuation in part of copending application Ser. No. 032,339, filed Jan. 9, 1987 now U.S. Pat. No. 4,750,867.

BACKGROUND OF THE INVENTION

The present invention relates to a hydraulic gear pump of the type which includes a toothed internal gear and a mating toothed external or pinion gear, and wherein the teeth define fluid cells which are alternately expanded and compressed upon rotation of the gears. Such gear pumps are commonly used as the lubricating oil pump for the internal combustion engine of an automobile.

The internal combustion engine of an automobile operates under unique conditions, in that it is operated at very different and constantly changing operating speeds and loads, starting with the idling speed and ending with the maximum operating speed under heavy load. The lubricating oil system must therefore satisfy the maximum load conditions, but at the same time it should not unnecessarily consume energy at the lower speed and load ranges.

The internal combustion engine of an automobile should also meet the further requirement of long service life, without requiring extensive maintenance. This is rendered difficult by the face that the engine is subject to wear, which leads to an increased consumption of the lubricating oil, and to a pressure drop in the lubricating oil system. The oil pump must therefore be adapted to this increasing need during the service life of the engine, and this increased capacity results in a corresponding energy loss during times when the increased capacity is not required.

The above cited copending applications describe a lubricating oil system which delivers an adequate quantity of the lubricating oil under all operating conditions, and yet avoids losses from excessive capacity. More particularly, the copending applications describe an internal gear pump wherein the teeth interengage so as to define fluid cells which are alternately expanded and compressed upon rotation of the gears. Preferably at least three cells of decreasing volume define the outlet zone, and a number of ports extend through the wall of the housing and which correspond in number to the number of decreasing cells. Some or all of these outlet ports terminate in the lubricating oil outlet passage, and those ports which are associated with the cell having the greatest volume include a non-return valve. Thus only the ports associated with the smallest fluid cells may directly communicate with the outlet passage and without a non-return valve. An internal gear pump of the described type is also illustrated in DE-OS Nos. 34 44 859 and 35 06 629.

In the above cited copending applications, a throttling means is positioned in the fluid inlet line. More particularly, a fixed throttle is positioned in a first fluid line leading to the inlet port from an oil tank, and there is further provided a by-pass line which is parallel to the first line. A pressure controlled throttle valve is positioned in the by-pass line, which is controlled by the outlet pressure of the lubricating oil pump, and which in turn controls flow through the by-pass so that the by-pass closes when the pressure in the fluid outlet of the pump reaches a predetermined valve. In this arrangement, the throttle in the first fluid line is designed so that the quantity of the lubricating oil which is delivered by the pump is dependent on the speed only up to a predetermined speed. This takes into account the fact that the lubricating oil consumption of the engine is dependent on the speed in the lower speed ranges. However, it is believed that the dependency of the lubricating oil consumption on speed exists only up to a certain threshold speed, and the throttle is dimensioned in accordance with this speed. Further, the lubricating oil system may be adapted to any increased additional requirement which may, for example, be required by wear, in that the resulting pressure drop may be used for opening the by-pass line. The opening of the by-pass line permits the entire delivery capacity, or an additional portion of the delivery capacity, of the lubricating oil pump to be made available.

It is an object of the present invention to provide a lubricating hydraulic pump of the described type, which provides the above described operational advantages achieved with the constructions disclosed in the copending applications, and which is also able to provide adequate lubrication during the initial cold operation of the engine. To achieve this objective, the present invention provides for a rapid heating of the lubricating oil and the engine to their operating temperature.

SUMMARY OF THE INVENTION

These and other objects and advanatages of the present invention are achieved in the embodiments illustrated herein by the provision of a hydraulic pump which comprises a pump housing, rotary means rotatably mounted within said pump housing and defining fluid cells which are alternately expanded and compressed upon rotation of said rotary means, fluid inlet means extending through said housing for delivering a fluid to each of said fluid cells while the fluid cells are in an expanded condition, said fluid inlet means including a fluid tank, and first and second parallel fluid lines communicating with said tank, and fluid outlet means extending through said housing and communicating with said fluid cells during compression thereof and such that the fluid in such fluid cells is expelled through said fluid outlet means. Further, a pressure controlled valve means is provided which is operatively connected to said fluid outlet means and to at least one of said first and second fluid lines. During normal operation of the engine, the flow is adjusted to the consumption of the engine by the pressure controlled valve means between a maximum flow rate at the lowest normal output pressure to a lower flow rate at the highest normal output pressure. Such control between the maximum and lower flow rates is dependent on the output pressure, and the lower flow rate is at least 30% of the maximum flow rate.

In the event the engine and oil are cold, the oil consumption is small, and even the lower flow rate as defined above is higher than the consumption of the cold oil. The pressure thus increases. In accordance with the present invention, the pressure controlled valve means provides a throttle for throttling a portion of the fluid from the fluid outlet means to the tank responsive to the output pressure reaching a predetermined relief pressure which is greater than the above defined highest normal output pressure, and such that the throttling of the fluid serves to increase the temperature thereof. The flow rate during such throttling should be at least 30% of the maximum flow rate, and also at least equal to or greater than the flow during normal operation at the highest pressure. This flow rate assures sufficient flow to meet the requirements of the engine and also provide sufficient flow through the throttle to rapidly increase the temperature of the oil. This desired flow rate is provided by appropriate design of the intake fluid lines.

In accordance with the present invention, the flow rate of the lubriacting oil which is delivered at the high relief pressure, is not limited to the lowest quantity which is required for an adequate lubrication, but is quantitatively within a range which corresponds at least approximately to the requirement in the normal operation. The invention is based upon the recognition that the engine requires very little lubricating oil when the engine and oil are cold. As a result, a high oil pressure developes in the lubricating oil system, which, according to known teachings (note DE-OS No. 35 06 629) would lead to the face that a greatly reduced oil delivery results and which is adapted to the low lubricating requirements of the oil. According to the present invention, however, an oil quantity which is greater than this low requirement is delivered at the high relief pressure.

The excessive oil quanity which is thus made available in cold operation, is then returned via the throttle and a pressure relief valve means to the tank. By returning the excessive oil quantity to the tank, a throttling of the oil in the valve means occurs, and the pressure of the oil is reduced from the pressure in the system (e.g. 6 bar) to the pressure in the tank (1 bar). This loss of energy results in a corresponding heating of the oil.

In one embodiment of the invention, the pressure controlled valve means is designed as a unitary structure for providing both the flow control function during normal operation and the pressure relief and throttling function during high pressure (i.e. cold) operation. In another embodiment, separate valves are provided for these two functions.

The throttling of the oil in the intake may be effected by a throttle or a diaphragm. In this regard, reference is made to Backe, "Grundlagen der Oelhydraulic" (Basics of Oil Hydraulics), Fourth Edition, 1979, Page 47 et seq. for a discussion of the difference between a throttle and a diaphragm. While the following description uses only the term "throttle", it will be understood that the term includes a diaphragm in the technical sense.

In accordance with the present invention, the throttle in the intake of the lubricating oil pump is preferably designed or controlled so that at the highest or relief pressure of the oil, a flow rate is provided which is at least 30% of the normal oil consumption, and which is also at least equal to or greater than the flow during normal operation at the highest pressure. Normal oil consumption is here defined as the oil consumption of the engine which occurs when the engine and oil are at the operating temperature. This normal oil consumption of the engine corresponds to the normal delivery of the lubricating pump. The normal delivery is adjusted to the oil consumption of the engine by the pressure controlled valve means, when the oil and engine are at their operating temperature, and the pump is driven at a speed at which its output is speed independent.

The normal oil consumption is of course dependent on the size of the engine and typically ranges between 8 and 20 l/min. However, the output of the pump at relief pressure is also dependent on the desired time of heating. Preferably, this output ranges between 70% and 100% of the normal oil consumption. Depending on the design of the throttle in the intake, this output is not only dependent on the cross section of the aperture and the other design features of the throttle, but it also depends on other properties such as the viscosity of the oil and the temperature of the oil. In this regard, one may proceed from the fact that the throttling means in the intake should be designed so that the output of the pump during throttling, at the maximum pressure of the lubricating oil system and at an oil temperature which is lower than the operating oil temperature (about 90° C.), should amount to a multiple of the minimum consumption of the engine at the same oil temperature, e.g., at least 2 times and at the most 20 times. Minimum consumption of the engine is here defined as the oil consumpiton of the engine which occurs when the lubricating oil and the motor are cold (20° C.), and the maximum allowed i.e. relief pressure exists in the lubricating oil system when the excessive quantities of oil are discharged, via the pressure relief valve, into the oil sump. The design of the throttle in the intake should also take into account that there is a pressure drop at the throttle, which is typically about one bar.

In one very compact embodiment of the present invention, the intake oil is guided through two fluid lines, namely a first line and a by-pass line. These two lines are parallel to each other and are controlled by a common pressure controlled valve. The fluid lines are selectively closed in the pressure controlled valve so that at the maximum pressure the by-pass line, which is adjustably throttled by the throttle valve, is closed, whereas the first line containing a fixed throttle is completely open. The throttling is so designed that in this first fluid line the fixed throttle has an opening cross section which insures the minimum output at a pressure difference of one bar. On the other hand, the lines are selectively closed at the operating pressures so that the first line containing the fixed throttle is closed at the lowest normal output pressure, and so that the lubricating oil moves only through the pressure controlled variable throttling point of the pressure controlled valve and the by-pass line. The pressure controlled valve itself is designed so that when the first line is open widest, the entire lubricating oil requirement can be met through this first line.

In an alternative embodiment, and as described in the copending applications cited above, the inlet oil is guided via a first inlet line having a fixed throttle, and a parallel by-pass line which passes through a pressure controlled throttle of the throttle valve. According to the present invention, the fixed throttle is provided with a cross section which insures the minimum output as defined above at a pressure difference of one bar.

The hydraulic pump of the present invention is adapted to provide a lubricating oil system for an internal conbustion engine, the delivery of which is adjusted by a pressure control to the requirements of the lubricating oil without energy being wasted. The system of the present invention also provides for the rapid heating of the cold engine. In addition, a further special requirement for the lubricating oil may develop, for example, when an additional consumer is to be connected to the lubricating oil system. To this end, the pressure controlled valve may be designed to be biased by two different counter pressures. Reversal is effected by an electromagnetic valve, which monitors preset operating conditions, such as the temperature of the lubricating oil, the temperature of certain machine parts, or the like.

In normal operation, the pressure controlled valve may be biased either by the tank pressure or external pressure. In this event, the control piston of the pressure controlled valve is biased by the pressure of the lubricating oil system on one side, and by a spring and the tank or atmospheric pressure on the other side. In the other switched position of the electromagnetic valve, the pressure controlled valve can be connected with the pressure in the intake line which is less than atmospheric, i.e. an underpressure. This means that the pressure of the lubricating oil overcomes the spring force including the counterpressure, and keeps the pressure controlled valve open until a correspondingly higher pressure of the lubricating oil has been obtained. Then, the additional consumer can be supplied, for example via an excess pressure valve, which opens at the now adjusted higher pressure.

BRIEF DESCRIPTION OF THE DRAWINGS

Some of the objects and advantages of the present invention having been stated, others will appear as the description proceeds, when take in conjunction with the accompanying drawings, in which.

DETAILED DESCRIPTION OF THE PREFERRED EMBODIMENTS

Figure 1:
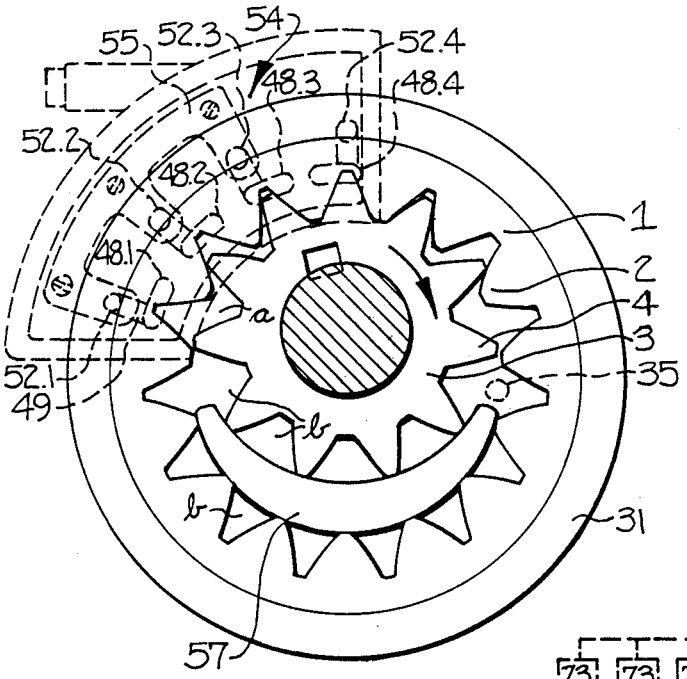
FIG. 1 is a sectional front view of a hydraulic pump embodying the features of the present invention.
Figure 2:
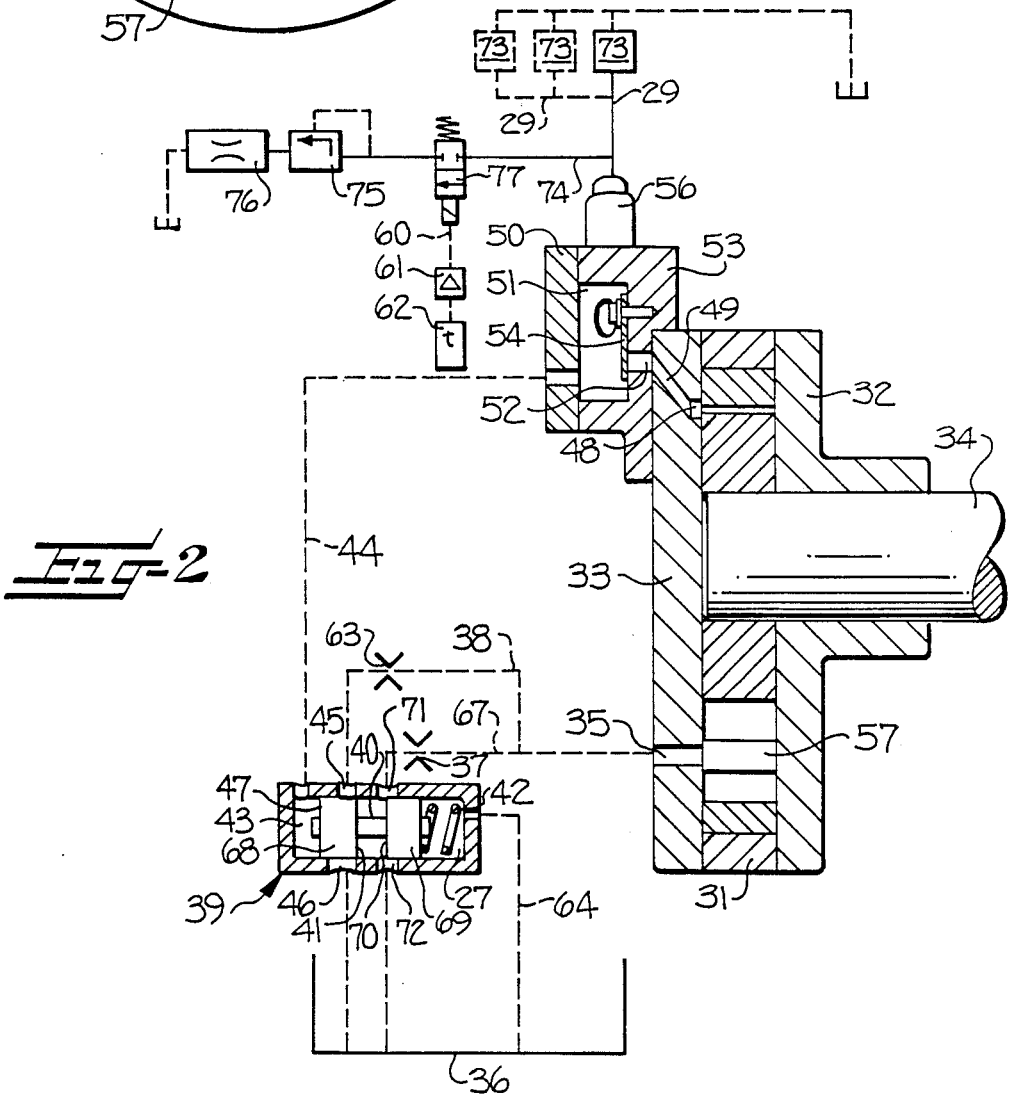
FIG. 2 is a sectional side elevation view of the pump shown in FIG. 1, together with a schematic illustration of the control means of the present invention.

Referring more particularly to the embodiment of FIGS. 1 and 2, a hydraulic pump is illustrated which comprises a pump housing 31, which is closed on its front and rear sides by covers 33 and 32 respectively. A shaft 34 is rotatably supported in the cover 32 and is driven by a suitable motor (not shown).

A toothed internal gear 1 is rotatably mounted within the housing 31 to define a central axis. Also, a toothed external or pinion gear 3 is fixedly mounted on the shaft 34, and so that the gear 3 rotates about the axis of the shaft 34 which is eccentric to the central axis defined by the gear 1. The external gear 3 has a tooth system 4 which meshes with the internal tooth system 2 of the internal gear 1. To improve efficiency, a crescent shaped bar 57 is provided in the interior of the pump, and which is located outside the area of the tooth engagement. The crescent shaped bar follows essentially the contour of the addendum circles of the gears.

The meshing teeth of the gears 1, 3 define fluid cells a, b (FIG. 1) which are alternately expanded and compressed during rotation of the gears. Also, a fluid inlet means is provided for delivering a fluid such as oil to each of the fluid cells while the cells are in an expanded condition. This fluid inlet means comprises an inlet port 35 in the cover 33 of the pump housing, a supply tank 36, and parallel fluid lines 38, 67 extending between the tank 36 and the inlet port 35.

The fluid inlet port 35 is positioned so as to deliver the fluid to the fluid cells while they are in an expanded condition. Also, a fluid outlet means communicates with these fluid cells during compression thereof and such that the fluid in the cells is expelled through the fluid outlet means. More particularly, the fluid outlet means includes four outlet entrances 48.1, 48.2, 48.3, and 48.4, which are formed in the inside surface of the cover 33, along the rotational direction of the fluid cells. The outlet entrances are separated by a distance not greater than the pitch of the teeth of the gears, and each of the outlet entrances is connected with an outlet passage 49 which extends through the cover 33. Each outlet passage extends radially outwardly, as best seen in FIG. 2, as a result, each outlet passage terminates on the outside of the cover as closely as possible to the housing 31.

A discharge housing 50 is mounted on the cover 33 in a pressure tight arrangement, and the housing 50 forms a discharge chamber 51. The chamber 51 of the housing 50 includes openings 52.1, 52.2, 52.3, and 52.4 in the wall 53 thereof which respectively communicate with the four passages 49. Thus the chamber 51 is connected to all of the outlet entrances 48.1–48.4 via the four passages 49, and openings 52.1–52.4. The openings are closed by a one-way, non-return valve of flexible material 54, which is in the form of a M-shaped plate which is secured to the wall 53 of the discharge housing 50 by bolts. The M-shaped plate of the valve 54 defines blades which project from a transverse section 55 and so that the blades cover the openings 52.1–52.3 respectively. As a result, these blades function as one-way non-return valves, and they function to open the connection from the fluid cells formed between the teeth, via the outlet entrances 48.1–48.3, passages 49, and bores 52.1–52.3 only when the pressure of the associated fluid cell is at least equal to the pressure in the discharge chamber 51. The final and most compressed fluid cell and which is located adjacent the pitch point at the intersection of the pitch circles, is connected via the entrance 48.4 and the corresponding passage 49 and opening 52.4, directly into the discharge chamber 51, without having a one-way valve therein. The discharge chamber 51 in turn has an outlet which leads to a common outlet duct 56 and to a common lubricating oil duct 29.

A pressure controlled valve means 39 is positioned between the tank 36 and the inlet port 35. In the embodiment of FIG. 2, this pressure controlled valve means 39 comprises a tubular casing having closed opposite ends, a first pair of transversely aligned openings 71, 72 extending through the casing and communicating with the line 67, a second pair of transversely aligned openings 45, 46 extending through the casing and communicating with the line 38. A piston 40 is slideably mounted within the casing and comprises a pair of axially spaced apart cylinders 68, 69. The left and right sides of the cylinder 68 as seen in the drawings define control edges 47, 41 respectively, and the left side of the cylinder 69 defines a control edge 70. Also, it will be noted that the two pairs of openings 71, 72 and 45, 46 are axially separated a distance somewhat less than the separation between the edges 41 and 70 of the two cylinders of the piston.

Figure 3A:
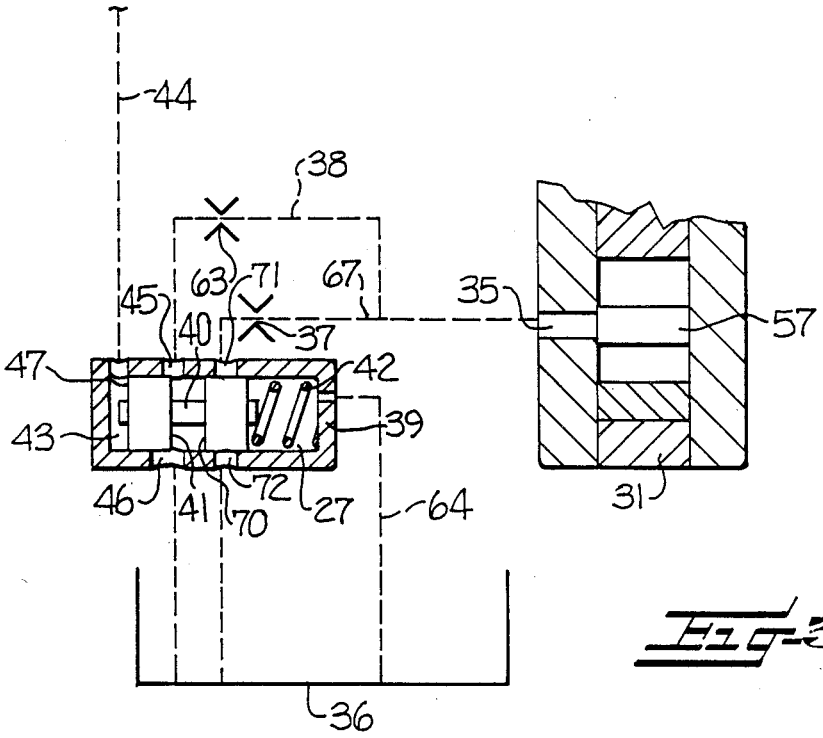
FIGS. 3A and 3B are fragmentary sectional views of the control means shown in FIG. 2, but under different operating conditions.

The piston 40 is mounted for movement between a first position as shown in FIG. 3A wherein the passage between the first pair of openings 71, 72 is closed and passage between the second pair of openings 45, 46 is open. In the second position of the piston, which is illustrated in FIG. 2, passage between the first pair of openings 71, 72 is open and passage between the second pair of openings 45, 46 is closed.

A further opening extends through the casing of the valve means 39 adjacent one of the closed ends, to define a pressure chamber 43 between the closed end and the piston. Also, the further opening communicates with the line 44, which leads to the chamber 51 of the fluid outlet means, so that the pressure of the fluid in the fluid outlet means is transmitted to the pressure chamber 43 and tends to bias the piston toward the right as shown in the drawings, i.e. from the first position toward the second position. A spring 42 is mounted in the casing at the opposite end of the piston for resiliently biasing the piston toward the left as seen in the drawings. Finally, the opposite or right closed end of the casing as shown in the drawings includes another opening which communicates with the tank 36 via the line 64.

To now describe the operation of the embodiment of FIG. 2, it will be understood that when the inlet port 35 is unthrottled, the fluid cells will be filled to their maximum, and the fluid is expelled on the discharge side. The degree of filling depends on the extent to which the inlet port 35 is throttled, in the manner further described below, but in any event, when the pressure is low the fluid cells are completely filled. This operating condition continues at low speeds of the automobile engine. Consequently, the flow of the lubricating oil is, according to requirements, proportional to the speed.

When, as the speed increases, only a throttled oil stream reaches the inlet side, the fluid cells on the inlet side are only partially filled, and a vacuum is present in the unfilled portion of the cells. This results in the fact that the pressure in the relatively large fluid cells on the discharge side is initially lower than the pressure in the discharge chamber 51. As as result, the respective blades of the non-return valve 54 remain closed. As the cells on the discharge side become progressively smaller, the pressure therein increases, and those blades of the non-return valve open when the pressure in the cell is higher than or equal to the pressure in the discharge chamber 51. As a result, the pump continues to deliver a speed independent, constant quantity of oil, and it is not necessary to divert an excess quantity of oil to a sump so as to incur corresponding losses of efficiency as the speed increases, and which is the case with conventional systems. However, if the requirement for lubricating oil increases, for example due to wear, the threshold pressure in the control pressure chamber 43 will be reached only at a higher speed.

Since, and as further described below, the throttling in the intake line is controlled as a function of the pressure in the chamber 43, the lubricating oil pump is able to adapt itself automatically to an increased demand. Thus, the pump will also satisfy an increasing need for lubricating oil during the entire service life of the automobile engine. At the same time, the pump will operate economically also in a new motor which requires relatively little lubricating oil, since this lubricating oil pump avoids an output, a portion of which is not needed and therefore diverted to the sump with a corresponding energy loss.

As long as no or only a slight discharge pressure exists in the control line 44 and in the control chamber 43, the piston cylinder 68 opens with its control edge 41 the passage of the by-pass line 38 across the openings 45 and 46. At this point, the lubricating oil can be taken in by the pump, without throttling, from the sump 36 through the throttle valve via the by-pass line 38. In this position, the intake line 67 is closed by the cylinder 69 of the piston, as can be seen in FIG. 3A. This position of the throttle valve insures the greatest normal output or satisfies the highest normal consumption of the engine.

When the pressure in the control chamber 43 increases and overcomes the spring force, the control edge 41 gradually closes the openings 45 and 46. This condition is illustrated in FIG. 3A, and represents the normal control range of the throttle valve in which the delivery of the pump is adapted by the regulation of the discharge pressure to the changing consumption in the normal operation of the motor, i.e., at the safe operating temperature of the oil.

When the pressure continues to increase, the control range of the valve is exceeded. Before the control edge 41 closes the openings 45, 46 completely however, the control edge 70 opens communication between the openings 71, 72 of the intake line 67, to an increasing extent. As the discharge pressure in the control line 44 further increases, the openings 45, 46 are entirely closed (FIG. 2). In this position both the openings 71 and 72 of the intake line 67 are completely opened.

At this point, the lubricating oil flows from the tank 36, via the fixed throttle 37 and line 67, to the inlet port 35. When the discharge pressure increases still further, the throttle valve functions as a pressure relief valve, in that the spring 42 is compressed so far that the front control edge 47 opens the control line 44 through the opening 46 to the tank. In so doing, however, the intake line 67 with openings 71, 72 remains completely open, note FIG. 3B.

Figure 3B:
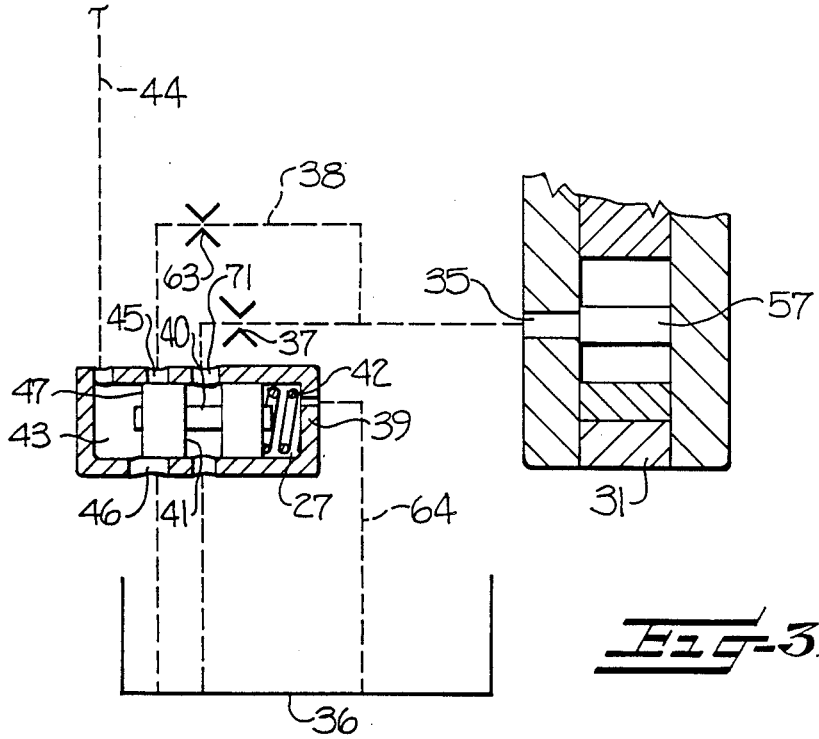

For the above reason, the outlet opening 46 is made axially longer in the direction toward the control chamber 43 than the inlet opening 45. As a result, the opening 45 remains closed by the cylinder 68, while the outlet opening 46 functions together with the control edge 47 as an outlet throttle, which regulates the discharge pressure of the lubricating pump in the chamber 51 to a constant maximum value. This maximum value is dependent on the magnitude of the spring force, and is shown in FIG. 3B. In so proceeding, the lubricating oil which is sucked in via intake line 67 and which escapes from the discharge chamber 51, via the control line 44, control chamber 43, outlet opening 46, and into the oil tank 36, is throttled at the throttling point between the control edge 47 and the outlet opening 46 from the maximum pressure of the discharge chamber 51 to the pressure in the oil tank 36. This throttling occurs with a loss of energy which is converted to a large extent into heat, and results in the heating of the oil.

The throttle 37 of the intake line 67, and the geometry of the pressure control valve, and in particular the configuration of the control cylinders 68, 69, control edges 47, 41, 70, and the positioning of the inlet and outlet openings 45, 46 and 71, 72, are designed so that in any event an adequately large cross section for the flow is maintained, and so as to be able to take in, at a theoretically possible largest suction height of one bar, a quantity of oil which is at least 30% of that quantity of oil which would flow at the largest possible cross section for the passages, assuming the viscosity and other conditions of the oil are the same.

Figure 5:
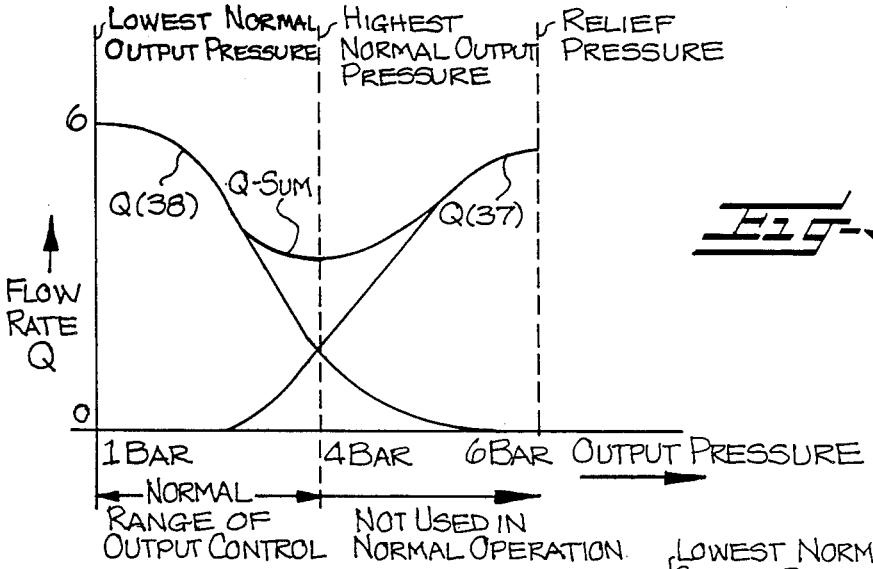
FIG. 5 is a diagram illustrating the relationship of the delivery pressure of the pump and the quantity of oil delivered, for the pump of FIG. 2.

The above interrelations are further illustrated in FIG. 5. At a very low pressure, the control edge 41 opens the openings 45, 46 of the by-pass line 38. As a result, the pressure control valve sucks in the largest possible quantity of oil Q. As the pressure increases above the pressure designated as the lowest normal output pressure in FIG. 5, and which is typically about 1 bar, this quantity of oil is reduced. This decrease in output continues until the highest normal output pressure is reached, which is typically about 4 bar. Between the lowest and highest output pressure as seen in FIG. 5 lies the normal control range of the pressure controlled valve, and of the entire lubricating oil system when the engine and the oil are at their operating temperature, which ranges for the oil between about 80° and 90° C.

As the pressure continues to increase beyond the highest normal output pressure, the quantity of flow along the control edge 41 to the by-pass line 38 continues to decrease. However, the control edge 70 of the piston cylinder 69 opens the openings 71, 72 to the intake line 67. As a result, the parallel flows add in such a manner that the sum of the oil streams at the inlet port 35 equals at least 30% of the maximum possible oil quantity, assuming the condition of the oil is the same. As the pressure increases still further, the openings 45, 46 in the by-pass line 38 are closed, and the openings 71, 72 to the intake line 67 are completely opened, so that a relatively large oil stream Q37 flows, which is approximately as large as the oil stream flowing in the normal operation.

Since a relatively large minimum quantity of oil is sucked in, advantages are obtained particularly in the cold operation of the engine, in that the engine and the oil heat up very rapidly, inasmuch as the relatively large oil quantity is diverted via the front control edge 47 into the tank when the predetermined relief pressure is reached. In so doing, the pressure in the oil is throttled from a maximum pressure, for example six bar, down to one bar. The energy necessary is converted to heat, which is delivered to the oil.

From the above, it will be seen that during the normal operating range of the output pressure, and which occurs at normal engine operating temperatures, the valve 39 operates to decrease the flow rate from the maximum flow rate at the lowest normal output pressure to a lower flow rate at the highest normal output pressure. The system will operate within this range unless the engine and oil are cold. In that event, the oil consumption is small, and even the lower flow rate as defined above is higher than the consumption of the cold oil. Therefore, the pressure necessarily increases until the higher predetermined relief pressure is reached, and at this relief pressure the valve 39 opens the opening 46 to the tank causing the surplus oil to be throttled to the tank, which in turn causes the temperatures of the oil to increase. Also, the system is designed such that during throttling the oil intake, which equals this throttled surplus plus the oil consumed for lubrication, is at least 30% of the output at the lowest normal operating pressure (1 bar), to thereby assure a sufficient flow for throttling and a rapid temperature increase.

The lubricating oil pump of the present invention will also satisfy additional requirements of special operating conditions. Thus it may occur, for example, that the lubricating oil heats to an extreme temperature, or that the engine parts need to be cooled by the lubricating oil as a result of special requirements as to performance. To meet these demands, the pressure line 56 on the discharge side of the pump branches into two systems. Specifically, the lubricating oil is supplied via a line 29 to a plurality of bearings and lubricating points 73. From each lubricating point a discharge line leads to the tank. The lubricating oil line 29 is secured by the pressure controlled throttle valve 39, which functions as a pressure relief valve in this respect. The adjustment of the spring 42 insures that the pressure does not exceed a safe limit. For example, a maximum pressure of six bars may be selected.

A second oil line 74 leads to a special consumer 76 via a pressure relief valve 75. The consumer 76 requires lubricating oil only in special situations, and the consumer 76 may, for example, be a nozzle for cooling the piston, and which is only put in operation when a cooling of the piston is needed or when sufficient lubricating oil is available. The pressure relief valve 75 is so adjusted that it opens at a lower pressure than is required for the pressure relief function of throttle valve 39, i.e. for the control edge 47 to reach the outlet opening 46 in the throttle valve 39. As a result, the special consumer receives lubricating oil only when an adequate supply of lubricating oil is available in the line 29. Additionally, a pilot valve 77 may be interposed in the pressure line 74, which is operated electromagnetically. This valve is actuated by a temperature sensor 62 via a signal line 60 and an amplifier 61. This permits the monitoring, for example, of the oil temperature or the temperature of a machine part such as a piston. Likewise, it is possible to use another measuring instrument in the place of the temperature sensor 62, such as a tachometer. In a like manner, the signaling line may be used to monitor other extraordinary operating conditions. In any event, the valve 77 serves the purpose of meeting with an extraordinary requirement.

The indicated adjustment of the pressure relief valve 75 and the throttle valve 39 insures that in any event the supply of lubricating oil to the points 73 is maintained, without leaving the control range of the throttle valve 39.

Figure 4:
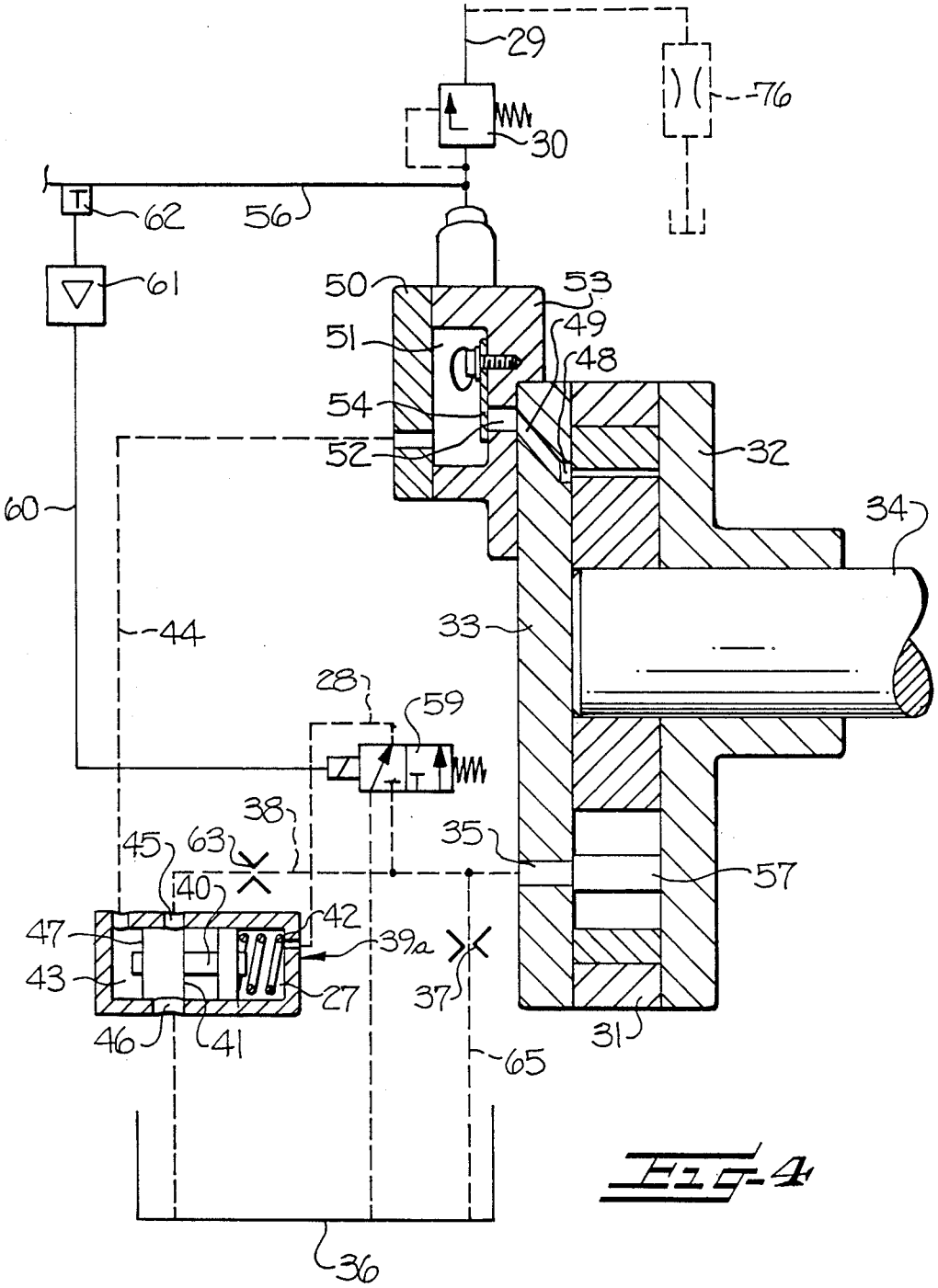
FIG. 4 is a view similar to FIG. 2 and illustrating a further embodiment of the invention.
Figure 6:
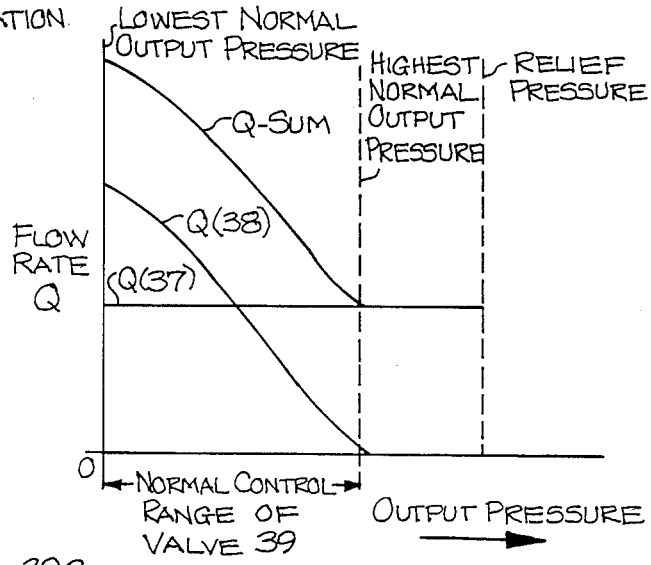
FIG. 6 is a diagram similar to FIG. 5, but for the pump of FIG. 4.

In the embodiment of FIG. 4, the fluid inlet means comprises a first fluid line 65 extending from the tank 36 to the port 35, with a fixed throttle 37 mounted therein. Also, a second fluid line 38 is provided, which is parallel to the first line 65, and with the second 38 including a pressure controlled valve means **39*a* therein. The valve means 39*a* includes a piston 40 which is axially movable in the supporting tubular casing, and so as to control the passage of the fluid from the tank 36 and through the openings 45, 46 in the casing. For this purpose, the piston includes a control edge 41 which cooperates with the openings 45 and 46, and the piston is biased by a spring 42 toward the left as seen in FIG. 4 and so as to open through the openings. The opposite control edge 47 of the piston is biased by the pressure in the control chamber 43, which is connected via a control line 44 to the output pressure of the pump in the manner described above. As long as there is little or no discharge pressure in the control line 44 and in the control chamber 43, the piston releases the passage between the openings 45, 46, and the lubricating oil can then flow in an unlimited quantity from the tank 36 to the pump, via both the throttle 37 and the by-pass line 38. When the pressure in the control chamber 43 increases to the lowest normal output pressure as shown in FIG. 6, it overcomes the force of the spring 42, and the inlet opening 46 is progressively closed relative to the outlet opening 45. When the highest normal output pressure is reached, only a throttled oil stream continues to flow from the tank 36 through the first line and throttle 37 and to the inlet port 35 of the pump. Thus within the normal control range, the valve means 39***a* acts to decrease the flow rate from a maximum flow rate at the lowest normal output pressure to a lower flow rate at the highest normal output pressure. If the outlet pressure continues to increase to the predetermined relief pressure, the pressure controlled valve 39*a* will operate as a pressure relief valve. More particularly, the spring 42 is compressed to an extent such that the front control edge 47 of the piston opens the pressure line 44 to the opening 46 and to the tank 36.

Preferably, the fixed throttle 37 in the intake line 65 is designed so that the throughput at a pressure difference of 1 bar corresponds to the lower flow rate of the pump obtained when the by-pass line 38 is closed by the throttle valve 39*a*. For this purpose, the fixed throttle 37 has a sufficiently large cross-sectional opening to assure this desired minimum output, which, as indicated above, is at least 30% of the maximum flow rate. As the pressure increases above the highest normal output pressure, the flow rate remains the same as indicated in FIG. 6, and thus upon reaching the relief pressure at which throttling of the output begins, the flow rate will also be at least 30% of the maximum flow rate.

Further provided in the embodiment of FIG. 4 is an additional control for the valve 39*a*, and which includes a magnetic valve 59. The magnetic valve 59 permits the monitoring of an operating condition of the lubricating oil, such as its temperature. Thus there is provided a measuring instrument such as a temperature sensor 62, an amplifier 61, and a signaling line 60 which leads to the valve 59, and for moving the valve between its two positions.

When idle, the valve 59 connects the spring chamber 27 of the pressure control valve 39*a* with the intake port 35. Here, it should be emphasized that an underpressure exists due to the throttling between the tank 36 and the port 35. In its other position, the valve 59 connects the spring chamber 27 with the tank 36 via the line 28. This switching of the valve 59 to the tank pressure, which is higher than the intake pressure, causes the spring force and the tank pressure to overcome the system pressure of the lubricating oil which was previously operative via the control line 44, and to move the control piston 40 to the left as seen in FIG. 4. As a result, the throttling on the control edge 41 is partially discontinued, so that a larger oil stream is available and the greater demand of the system for lubricating oil can be met. By reason of the greater bias on the spring side of the control piston 40, a higher pressure is provided in the lubricating oil system. An additional pressure relief valve 30 may therefore be provided in the connecting line 29, and the valve 30 is adjusted so that when it opens at a higher pressure, the additionally delivered lubricating oil can be supplied to the additional consumer 76. This system can for example be applied for cooling the engine parts with lubricating oil.

Figure 7:
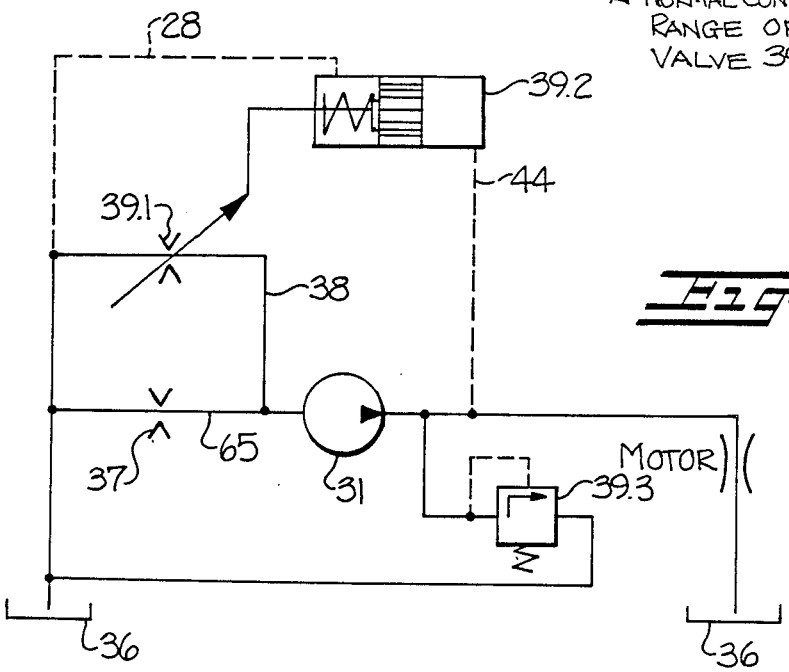
FIG. 7 is a schematic diagram illustrating another embodiment of the pressure controlled valve means of the present invention.

FIG. 7 is a schematic diagram which illustrates another embodiment of the pressure controlled valve means of the present invention. In this embodiment, the pressure controlled valve means comprises a pressure controlled valve 39.1 which is controlled by a piston actuator 39.2, and which serves to control or modify the flow through the second fluid line 38 within the normal range of output control as defined above. More particularly, the valve 39.1 is designed to decrease the flow rate within this range from a maximum flow rate at the lowest normal output pressure to a lower flow rate at the highest normal output pressure. This lower flow rate is at least 30% of the maximum flow rate and is higher than the oil consumption of the engine, when the engine and the oil are cold. In addition, the valve means of this embodiment comprises a separate pressure relief valve 39.3 which includes a throttle connecting the pump outlet to the tank. The valve 39.2 opens a connection betwen pump outlet and tank via said throttle at a predetermined relief output pressure which is greater than the highest normal output pressure, and releases the portion of the flow rate exceeding the oil consumption of the engine via said throttle to the tank to increase the temperature thereof. The flow rate during such throttling is the same as at the lower flow rate, note FIG. 6, and thus it is also at least 30% of the maximum flow rate.

In the drawings and specification, a preferred embodiment of the invention has been illustrated and described, and although specific terms are employed, they are used in a generic and descriptive sense and not for purposes of limitation.

We claim:

1. A hydraulic pump adapted for supplying lubricating oil to an internal combustion engine, and comprising a pump housing, rotary means rotatably mounted within said pump housing and defining fluid cells which are alternately expanded and compressed upon rotation of said rotary means, fluid inlet means extending through said housing for delivering a fluid to each of said fluid cells while the fluid cells are in an expanded condition, said fluid inlet means including a fluid tank, and first and second parallel fluid lines communicating with said tank, fluid outlet means extending through said housing and communicating with said fluid cells during compression thereof and such that the fluid in such fluid cells is expelled through said fluid outlet means, and pressure controlled valve means operatively connected to said fluid outlet means and to at least one of said first and second fluid lines, for modifying the flow through said lines as the output pressure increases by changing the flow rate from a maximum flow rate at a lowest normal output pressure to a further flow rate at a predetermined higher relief output pressure, and such that said further flow rate is at least 30% of said maximum flow rate, and wherein said pressure controlled valve means includes means for throttling a portion of the fluid from said fluid output means to said tank responsive to the output pressure reaching said predetermined relief output pressure, and such that the throttling of the fluid serves to increase the temperature thereof.

2. The hydraulic pump as defined in claim 1 wherein said fluid outlet means includes an output line adapted to lead to a consumer, and pressure operated valve means disposed in said output line so as to open upon a predetermined pressure being present in said outlet line which is lower than said predetermined relief output pressure.

3. The hydraulic pump as defined in claim 1 wherein said rotary means comprises a toothed internal gear rotatably mounted with said housing to define a central axis, and a toothed external gear mounted within said housing for rotation about an axis which is eccentric to said central axis, and with the teeth of said external gear meshing with the teeth of said internal gear and such that the interengaging teeth define said fluid cells.

4. The hydraulic pump as defined in claim 3 wherein said fluid outlet means includes a plurality of separate outlets extending through said housing and positioned along the rotational direction of said fluid cells, and with the outlets being separated by a distance not greater than the pitch of the teeth of said gears.

5. The hydraulic pump as defined in claim 4 wherein at least the upstream ones of said outlets include one way valve means mounted therein to permit flow only from said housing.

6. A hydraulic pump adapted for supplying lubricating oil to an internal combustion engine, and comprising a pump housing, rotary means rotatably mounted within said pump housing and defining fluid cells which are alternately expanded and compressed upon rotation of said rotary means, fluid inlet means extending through said housing for delivering a fluid to each of said fluid cells while the fluid cells are in an expanded condition, said fluid inlet means including a fluid tank, and first and second parallel fluid lines communicating with said tank, fluid outlet means extending through said housing and communicating with said fluid cells during compression thereof and such that the fluid in such fluid cells is expelled through said fluid outlet means, and pressure controlled valve means operatively connected to said fluid outlet means and to at least one of said first and second fluid lines (a) for modifying the flow through said first and second fluid lines within a normal range of output control which is defined between a lowest normal output pressure and a highest normal output pressure, including decreasing the flow rate within said range from a maximum flow rate at said lowest normal output pressure to a lower flow rate at said highest normal output pressure, and (b) for providing a further flow rate at a predetermined relief output pressure which is greater than said highest normal output pressure, with said further flow rate being at least 30% of said maximum flow rate and at least equal to said lower flow rate, and while throttling a portion of the fluid from said fluid output means to said tank, and such that the throttling of the fluid serves to increase the temperature thereof.

7. The hydraulic pump as defined in claim 6 wherein said pressure controlled valve means comprises a pressure controlled valve mounted in one of said first and second fluid lines for performing said function (a), and a separate pressure relief valve mounted in a line extending from said fluid outlet means to said tank for performing said function (b).

8. A hydraulic pump adapted for supplying lubricating oil to an internal combustion engine, and comprising a pump housing, rotary means rotatably mounted within said pump housing and defining fluid cells which are alternately expanded and compressed upon rotation of said rotary means, fluid inlet means extending through said housing for delivering a fluid to each of said fluid cells while the fluid cells are in an expanded condition, said fluid inlet means including a fluid tank, and first and second parallel fluid lines communicating with said tank, fluid outlet means extending through said housing and communicating with said fluid cells during compression thereof and such that the fluid in such fluid cells is expelled through said fluid outlet means, and pressure controlled valve means comprising a tubular casing having opposite ends, a first pair of transversely aligned openings extending through said casing and communicating with first line, a second pair of transversely aligned openings extending through said casing and communicating with said second line, a piston slideably mounted in said casing for movement between a first position wherein passage between said first pair of openings is closed and passage between said second pair of openings is open, and a second position wherein passage between said first pair of openings is open and passage between said second pair of openings is closed, a further opening extending through said casing adjacent one of said ends to define a pressure chamber between said one end and said piston, a further fluid line extending between and communicating with said fluid outlet means and said further opening so that the pressure of the fluid in said fluid outlet means is transmitted to said pressure chamber and tends to bias the piston from said first position towared said second position, and means for resiliently biasing said piston toward said first position, said piston and said first and second pairs of openings being dimensioned and arranged such that the total flow through said first and second fluid lines is at a relatively high level when said piston is in said first position, and the total flow decreases to a minimum amount and then increases as the piston moves from said first position to said secon position, and wherein said second fluid line includes a segment extending between said tank and one of said second pair of openings, and wherein said one opening extends axially further than the other of said second pair of openings toward said pressure chamber, and such that said one opening communicates with said pressure chamber upon a relatively high pressure being present therein and such that the fluid is throttled across said one opening and to said tank to increase the temperature of the fluid.

9. The hydraulic pump as defined in claim 8 wherein said first and second pairs of openings in said casing are axially separated, and said piston comprises a pair of axially separated cylinders, with said pairs of openings being axially separated somewhat less than the axial separation of said cylinders.

10. The hydraulic pump as defined in claim 9 wherein said fluid outlet means includes a plurality of separate outlet lines which are adapted to lead to separate consumers, and pressure operated valve means disposed in at least one of said outlet lines so as to open only upon a predetermined pressure being present in said outlet lines.

11. The hydraulic pump as defined in claim 10 wherein said pressure operated valve means is constructed to open at a pressure lower than said relatively high pressure at which communication is established between said pressure chamber and said tank through said one opening.

12. A hydraulic pump adapted for supplying lubricating oil to an internal combustion engine, and comprising a pump housing, rotary means rotatably mounted within said pump housing and defining fluid cells which are alternately expanded and compressed upon rotation of said rotary means, fluid inlet means extending through said housing for delivering a fluid to each of said fluid cells while the fluid cells are in an expanded condition, said fluid inlet means including a fluid tank, and first and second parallel fluid lines communicating with said tank, with said second line including a pressure controlled valve therein, and with said first fluid line being sized and configured so as to permit a flow rate of at least 30% of the flow rate through said second line, fluid outlet means extending through said housing and communicating with said fluid cells during compression thereof and such that the fluid in such fluid cells is expelled through said fluid outlet means, and control means operatively interconnecting said pressure controlled valve and said fluid outlet means and for opening the pressure controlled valve when the pressure in said fluid outlet means is below a predetermined low value and progressively closing said pressure controlled valve as the pressure in said fluid outlet means increases from said predetermined low value to a predetermined higher value, and wherein said pressure controlled valve means includes throttle means for opening said fluid outlet means to said tank when a predetermined relatively high pressure is present in said fluid outlet means which is greater than said predetermined higher value, and such that passage of the fluid through said throttle means acts to increase the temperature thereof.

13. The hydraulic pump as defined in claim 12 wherein said pressure controlled valve means comprises a tubular casing having opposite ends, a pair of transversely aligned openings in said casing and communicating with said second fluid line, a piston slideably mounted is said casing for movement between a first position wherein passage between said pair of openings is open and a second position wherein such passage is closed, a further opening extending through said casing adjacent one of said ends to define a pressure chamber between said one end and said piston, with said further opening communicating with said fluid outlet means so that the pressure of the fluid in said fluid outlet means is transmitted to said pressure chamber and tends to bias the piston from said first position toward said second position, and means for resiliently biasing said piston toward said first position.

14. The hydraulic pump as defined in claim 13 wherein said fluid inlet means further comprises an intake port extending through said pump housing, and wherein said biasing means comprises an additional opening extending through said tubular housing adjacent the end opposite said pressure chamber, and means for selectively interconnecting said additional opening with either said tank or said intake port.

15. The hydraulic pump as defined in claim 14 wherein said second fluid line includes a segment extending between said tank and one of said pair of openings, and wherein said one opening extends axially closer to said one end of said casing than the other of said openings, and wherein said throttling means comprises the portion of said one opening which extends axially closer to said one end of said casing, and such that said portion of said one opening communicates with said pressure chamber upon said predetermined relatively high pressure being present therein and such that the fluid is throttled across said one opening and to said tank to increase the temperature of the fluid.

* * * * *

UNITED STATES PATENT AND TRADEMARK OFFICE

CERTIFICATE OF CORRECTION

PATENT NO. : 4,850,814

DATED : July 25, 1989

INVENTOR(S) : Siegfried Hertell and Dieter Otto

It is certified that error appears in the above-identified patent and that said Letters Patent is hereby corrected as shown below:

Column 1, line 32, change "face" to -- fact --.

Column 2, line 2, change "valve" to --value--.

Column 3, line 21, change "face" to -- fact --.

Column 10, line 56, after "open" insert -- passage --.

Column 12, line 2, change "is" to -- and actuator 39.2 are --.

Column 12, line 11, change "39.2" to -- 39.3 --.

Signed and Sealed this

Third Day of April, 1990

*Attest:*

HARRY F. MANBECK, JR.

*Attesting Officer*

*Commissioner of Patents and Trademarks*